US010483677B2

(12) United States Patent
Iida

(10) Patent No.: US 10,483,677 B2
(45) Date of Patent: Nov. 19, 2019

(54) CONNECTOR

(71) Applicant: Sumitomo Wiring Systems, Ltd., Yokkaichi, Mie (JP)

(72) Inventor: Masahiro Iida, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/959,391

(22) Filed: Apr. 23, 2018

(65) Prior Publication Data

US 2018/0309221 A1 Oct. 25, 2018

(30) Foreign Application Priority Data

Apr. 21, 2017 (JP) ..... 2017-084181

(51) Int. Cl.

| | |
|---|---|
| ***H01R 13/40*** | (2006.01) |
| ***H01R 13/436*** | (2006.01) |
| ***H01R 13/52*** | (2006.01) |
| ***H01R 13/641*** | (2006.01) |
| ***H01R 13/627*** | (2006.01) |

(52) U.S. Cl.

CPC ..... *H01R 13/4364* (2013.01); *H01R 13/5221* (2013.01); *H01R 13/6271* (2013.01); *H01R 13/641* (2013.01); *H01R 13/5219* (2013.01)

(58) Field of Classification Search

CPC ..... H01R 13/4364; H01R 13/5219; H01R 13/5221; H01R 13/6271; H01R 13/641

USPC ..... 439/595

See application file for complete search history.

(56) References Cited

U.S. PATENT DOCUMENTS

| | | | | |
|---|---|---|---|---|
| 6,280,237 | B1 * | 8/2001 | Saka | H01R 13/4361 439/271 |
| 6,443,764 | B2 * | 9/2002 | Makita | H01R 13/5219 439/271 |
| 6,659,797 | B2 * | 12/2003 | Ichio | H01R 13/4361 439/595 |
| 6,685,506 | B1 * | 2/2004 | Nakamura | H01R 13/631 439/595 |
| 6,786,754 | B2 * | 9/2004 | Yamaoka | H01R 13/635 439/153 |
| 6,786,756 | B2 * | 9/2004 | Mase | H01R 13/6272 439/271 |
| 6,786,768 | B2 * | 9/2004 | Murakami | H01R 13/4365 439/271 |

(Continued)

FOREIGN PATENT DOCUMENTS

JP 2006-19187 1/2006

*Primary Examiner* — Abdullah A Riyami
*Assistant Examiner* — Vladimir Imas
(74) *Attorney, Agent, or Firm* — Gerald E. Hespos; Michael J. Porco; Matthew T. Hespos

(57) ABSTRACT

A connector includes a housing body (11) having a reference surface (18) extending substantially along a front-rear direction, an arm body (21) extending substantially along the front-rear direction, and legs (22) coupling an intermediate location of the arm body (21) in the front-rear direction and the reference surface (18). The area of the arm body (21) before the location coupled to the legs (22) is a lock (31) and the area behind the location coupled to the legs (22) is a releasing portion (32). The releasing portion (32) is pressed toward the reference surface (18), thereby releasing a locked state of the lock (31) and a mating lock (94). The legs (22) are inclined forward from the side of the reference surface (18) toward the side of the arm body (21).

10 Claims, 6 Drawing Sheets

(56) References Cited

U.S. PATENT DOCUMENTS 6,793,513 B2 * 9/2004 Shibata ..... H01R 13/5219 439/271
6,910,905 B2 * 6/2005 Tanaka ..... H01R 13/5208 439/271
6,935,887 B2 * 8/2005 Endo ..... H01R 13/641 439/352
6,971,906 B2 * 12/2005 Yamaoka ..... H01R 13/6272 439/352
7,033,201 B2 * 4/2006 Ichida ..... H01R 13/6272 439/352
7,114,983 B2 * 10/2006 Fukatsu ..... H01R 13/4223 439/358
7,118,417 B2 * 10/2006 Aihara ..... H01R 13/6272 439/595
7,156,684 B2 * 1/2007 Ichida ..... H01R 13/6272 439/352
7,160,134 B2 * 1/2007 Ichida ..... H01R 13/6272 439/352
7,168,981 B2 * 1/2007 Takahashi ..... H01R 13/4223 439/595
7,172,442 B2 * 2/2007 Fukatsu ..... H01R 13/62938 439/157
7,252,530 B2 * 8/2007 Shamoto ..... H01R 13/641 439/352
7,281,961 B1 * 10/2007 Sugiyama ..... H01R 13/113 439/595
7,458,838 B2 * 12/2008 Itou ..... H01R 13/5208 439/271
7,530,838 B2 * 5/2009 Ohara ..... H01R 13/641 439/489
7,575,463 B2 * 8/2009 Mase ..... H01R 13/631 439/352
7,591,668 B2 * 9/2009 Nakamura ..... H01R 13/641 439/489
7,614,904 B2 * 11/2009 Hiramatsu ..... H01R 13/641 439/352
7,806,715 B2 * 10/2010 Zheng ..... H01R 13/641 439/352
8,052,489 B2 * 11/2011 Mase ..... H01R 13/4223 439/595
9,478,898 B2 * 10/2016 Iihoshi ..... H01R 13/5202
9,484,684 B2 * 11/2016 Tanikawa ..... H01R 13/6275
9,666,989 B2 * 5/2017 Horiuchi ..... H01R 13/64
9,948,025 B2 * 4/2018 Hashimoto ..... H01R 13/14
9,979,125 B2 * 5/2018 Hamada ..... H01R 13/5221
10,074,929 B2 * 9/2018 Il ..... H01R 13/5205
2001/0027058 A1 * 10/2001 Pederson ..... H01R 13/6272 439/595
2004/0087209 A1 * 5/2004 Nakamura ..... H01R 13/4364 439/595
2004/0180576 A1 * 9/2004 Hasebe ..... H01R 13/113 439/595
2005/0085126 A1 * 4/2005 Sagawa ..... H01R 13/4365 439/595
2005/0124216 A1 * 6/2005 Sagawa ..... H01R 13/4365 439/595
2005/0186842 A1 * 8/2005 Fukatsu ..... H01R 13/4223 439/595
2005/0250385 A1 * 11/2005 Tsuji ..... H01R 13/4365 439/595
2006/0003631 A1 * 1/2006 Fukatsu ..... H01R 13/4364 439/595

* cited by examiner

CONNECTOR

BACKGROUND

Field of the Invention

The present invention relates to a connector.

Related Art

Japanese Unexamined Patent Publication No. 2006-19187 discloses a connector with a male housing and a female housing connectable to each other. The female housing is provided with a lock arm extending in a front-rear direction along an outer peripheral surface. The lock arm is coupled to the outer peripheral surface of the female housing via a leg at an intermediate position in the front-rear direction. In the process of connecting the housings, the lock arm is pressed by a lock of the male housing to be inclined relative to a support. The lock arm resiliently returns when the housings are connected properly, and the lock of the male housing is fit into a lock hole provided in a front part of the lock arm to be locked. In this way, the housings are held in a connected state. On the other hand, if a releasing portion provided on a rear end part of the lock arm is pressed toward the outer peripheral surface of the female housing, the lock is separated from the loch hole. Thus, the locked state of the lock arm is released and the housings can be pulled apart from each other.

A height reduction of a connector may be required, for example, to prevent the connector installed in a vehicle from interfering with peripheral components. In this case, the height reduction of the connector can be realized by reducing a projecting dimension of a leg of the lock arm projecting from the outer peripheral surface of a female housing. However, if the projecting dimension of the leg is reduced, a height of a releasing space formed between the outer peripheral surface of the housing and a releasing portion also is reduced, thereby causing a problem that a releasing operation is difficult.

The invention was completed on the basis of the above situation and aims to improve releasing operability of a connector while achieving a height reduction.

SUMMARY

The invention is directed to a connector with a housing body connectable to a mating housing. The housing body a reference surface extending substantially along a front-rear direction. An arm extends substantially along the front-rear direction, and a leg couples an intermediate location of the arm in the front-rear direction and the reference surface. The area of the arm before the location coupled to the leg serves as a lock and the area of the arm behind the location coupled to the leg serves as a releasing portion. In the process of connecting the housing body to the mating housing, the arm resiliently returns and the lock engages a mating lock provided on the mating housing, whereas the releasing portion is pressed toward the reference surface to separate the lock from the mating lock and to release a locked state with the mating lock, when the arm is inclined with the leg as a support and the housing body is connected properly to the mating housing. The leg is inclined forward from the reference surface toward the arm.

The forward inclination of the leg from the reference surface of the housing toward the arm ensures a smooth inclination displacement of the arm and achieves a small height of the connector. A releasing space is ensured between the releasing portion, the reference surface and the leg for allowing a releasing operation of the releasing portion is configured to release the locked state of the lock and the mating lock portion. However, this releasing space portion becomes wider by as much as the leg is inclined forward. Thus, the releasing operation can be performed smoothly.

A surface of the releasing portion substantially facing the reference surface may be more distant from the reference surface than a surface of the lock substantially facing reference surface. Accordingly, the releasing space for allowing the releasing operation of the releasing portion is wider. Therefore, the releasing operation can be performed more smoothly.

The surface of the releasing portion facing the reference surface may define a slope inclined to be separated farther from the reference surface from the leg side toward a rear side. Thus, the releasing portion can be brought closer to the reference surface during the releasing operation and the releasing operation can be performed more smoothly.

At least one covering wall may be arranged in a space on a side substantially opposite to a side where the lock faces the reference surface. Thus, a height of the connector frequently is limited, and a benefit of applying the present teaching is significant.

A part between the surface of the releasing portion facing the reference surface and a rear surface of the leg may be curved. Thus, when the releasing portion is pressed, stress applied to a coupling location between the releasing portion and the leg can be dispersed and durability can be improved.

A space enclosed by the leg, a portion of the arm on the side of the releasing portion and the reference surface defines a releasing space for allowing the releasing portion to be displaced.

The connector may further comprise a detector to be inserted into a space of the housing body and/or substantially slidable with respect to the housing body between an initial position and a detection position to detect a proper connection of the housing body to the mating housing.

The invention also relates to a connector assembly comprising the above-described connector and a housing body connectable thereto.

These and other objects, features and advantages of the invention will become more apparent upon reading the following detailed description of preferred embodiments and accompanying drawings. It should be understood that even though embodiments are described separately, single features thereof may be combined to additional embodiments.

DETAILED DESCRIPTION

An embodiment of the invention is described with reference to FIGS. 1 to 6. A connector of this embodiment includes a housing 10 connectable to a mating housing 90 and a detector 60 assembled movably with the housing 10. Note that, in the following description, surfaces of the housings 10, 90 each other at the start of connection are referred to as fronts concerning a front-rear direction (or longitudinal direction LD), and a vertical direction is based on each figure except FIG. 5.

Figure 1:
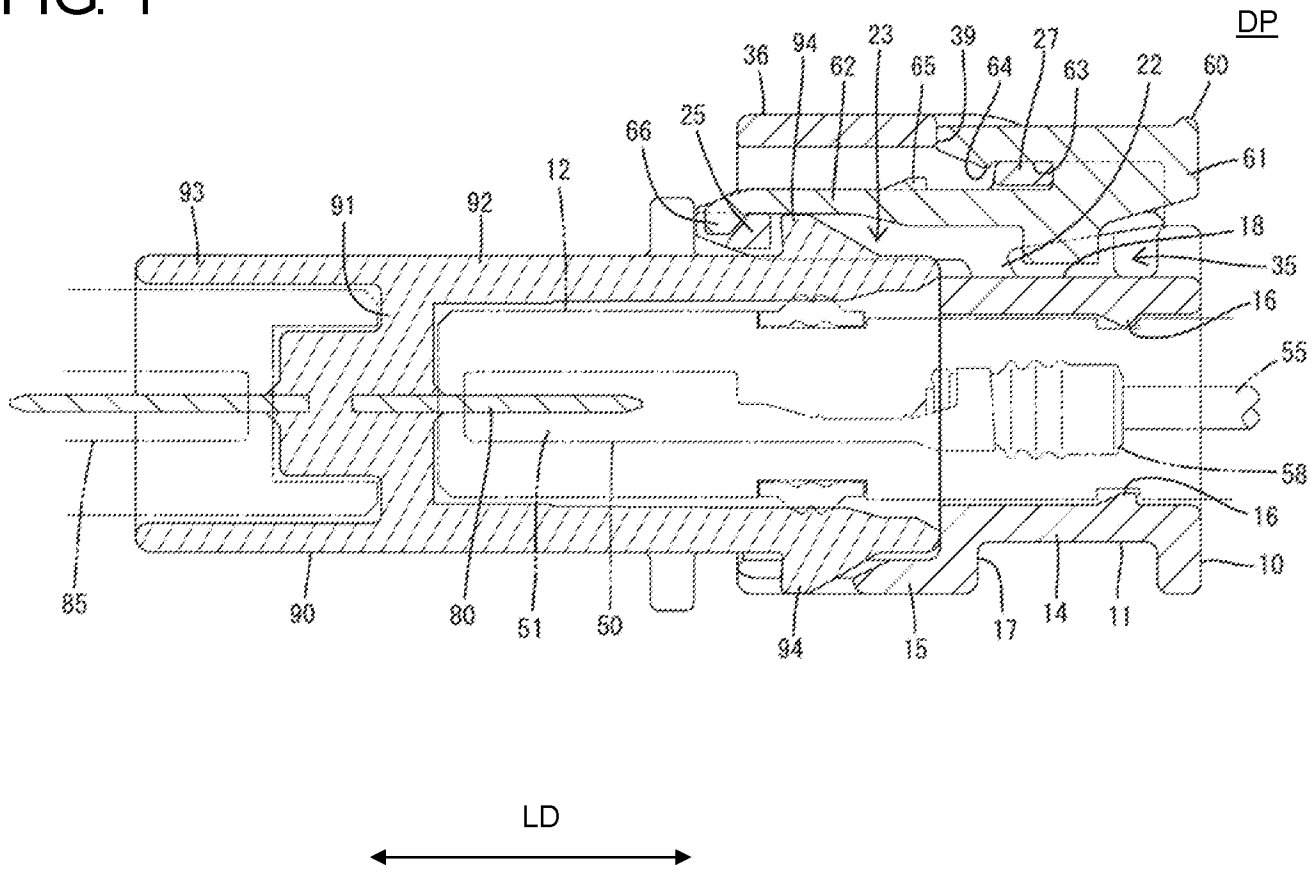
FIG. 1 is a section of a connector showing a state where a housing is connected properly to a mating housing and a detector is at a detection position.
Figure 2:
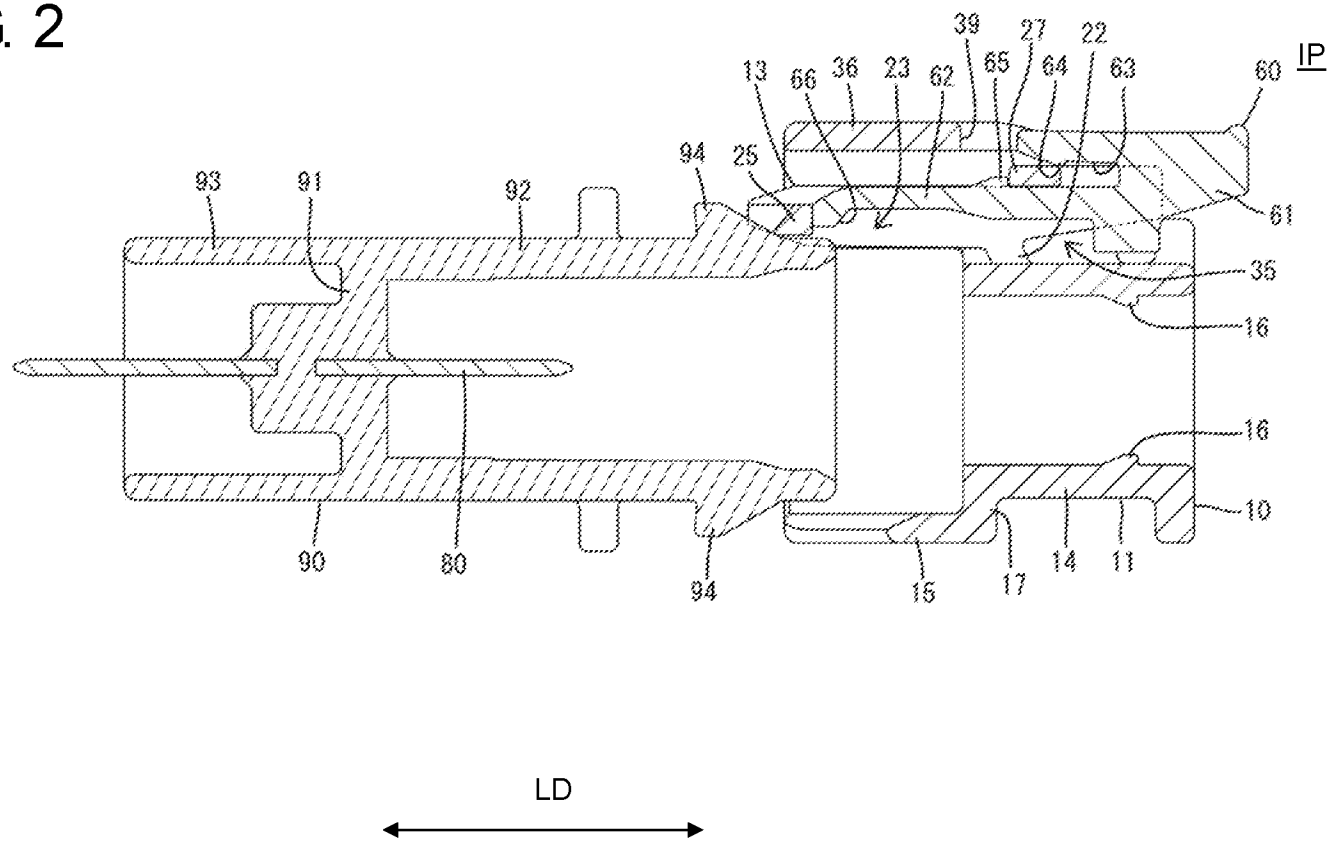
FIG. 2 is a partially omitted section showing a state while the housing is being connected to the mating housing.

The mating housing 90 is made e.g. of synthetic resin and includes, as shown in FIGS. 1 and 2, a terminal mounting portion 91 in the form of a vertical wall extending substantially along the vertical direction (or a direction substantially normal to the longitudinal direction LD) and a receptacle 92 projecting forward from the terminal mounting portion 91. The receptacle 92 is formed into a flat tubular shape long in a lateral direction. Tab-like mating terminal fittings 80 extending in the front-rear direction (or the longitudinal direction LD) are mounted into the terminal mounting portion 91 by press-fitting or insert-molding. A plurality of the mating terminal fittings 80 are arranged side by side in the lateral direction. A front part of each mating terminal fitting 80 is arranged to project into the receptacle 92 and electrically connected to a terminal fitting 50 to be described later. Further, a rear part of each mating terminal fitting 80 is arranged to project into a tubular portion 93 open on a side opposite to the receptacle 92 and electrically connected to another conductor portion 85 (terminal, conductive path of a board or the like).

Two mating locks 94 project on front end parts of upper and lower walls of the receptacle 92. Each mating lock 94 is in the form of a claw, the front surface thereof is inclined rearwardly and the rear surface thereof stands substantially vertically or perpendicular to the longitudinal direction LD. Note that the mating housing 90 is vertically symmetrically formed and connectable to the housing 10 without vertical distinction.

Figure 3:
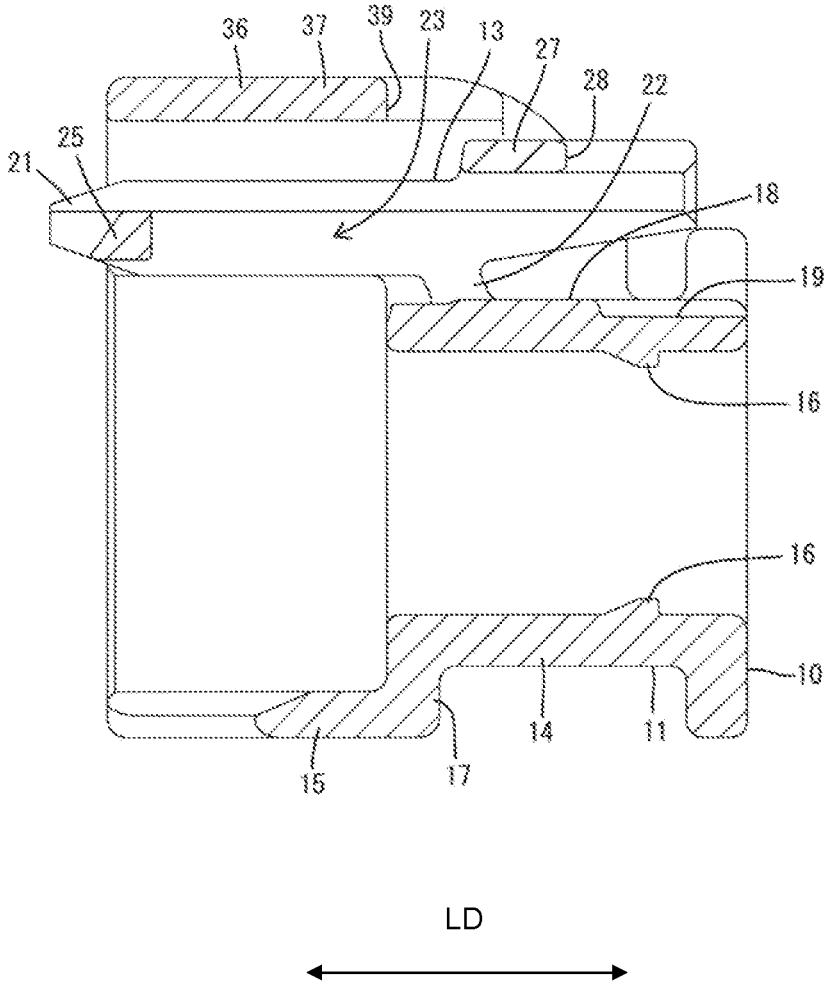
FIG. 3 is a partially omitted section of the housing.
Figure 6:
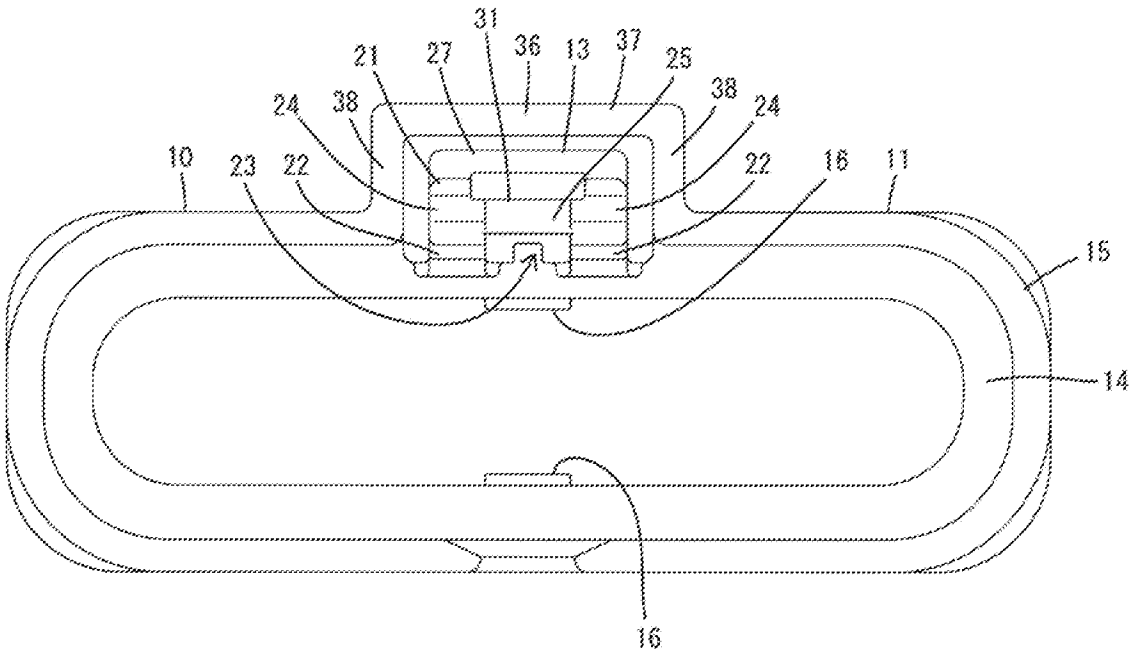
FIG. 6 is a front view of the housing.

The housing 10 also is made e.g. of synthetic resin and includes, as shown in FIG. 1, a housing body 11, an inner housing 12 and a lock arm 13. The housing body 11 has a wide flat tubular shape long, as shown in FIG. 6, and includes a reference tube 14 in a rear part and an outer tube 15 that is slightly larger than the reference tube 14 in a front part, as shown in FIG. 3. A front end part of the reference tube 14 and a rear end part of the outer tube 15 are coupled to each other via a radially extending link 17. The reference tube 14 and the outer tube 15 are coaxially hollow in the front-rear direction.

The lock arm 13 is integrated with the housing body 11 and projects on an upper wall outer surface of the reference tube 14. The inner housing 12 is separate from the housing body 11 and is held in the reference tube 14.

Although not shown in detail, the inner housing 12 includes a part in which the terminal fittings 50 can be accommodated side by side in the lateral direction. As shown in FIG. 1, a front part of the terminal fitting 50 includes a box portion 51 capable of receiving the tab-like mating terminal fitting 80 for connection, and a rear part thereof is connected to an end part of a wire 55. The outer periphery of the wire 55 is protected in a waterproof manner by a sealing member 58.

Projections 16 for retaining the inner housing 12 are provided in a laterally central part of the inner surface of the reference tube 14. Two of the projections 16 are arranged on upper and lower walls of the reference tube 14.

Figure 5:
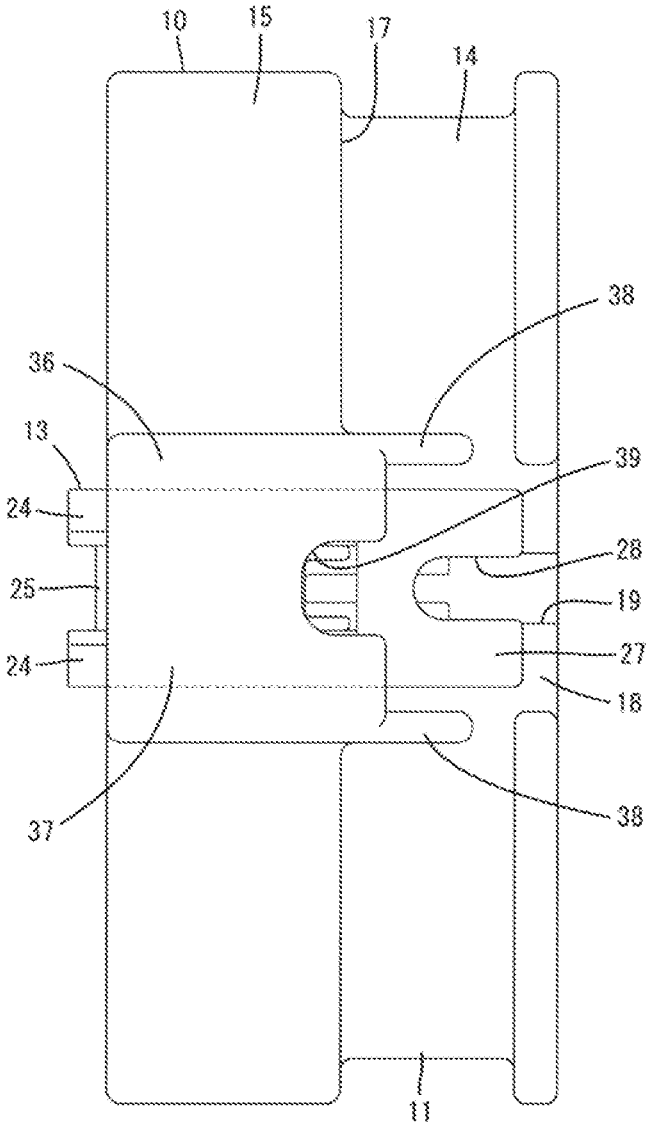
FIG. 5 is a plan view of the housing.

The upper wall outer surface of the reference tube 14 defines a flat reference surface 18 arranged substantially along the front-rear direction (or longitudinal direction LD) and/or the lateral direction. As shown in FIGS. 3 and 5, a shallow recess 19 substantially rectangular in a plan view and open rearward is provided in a laterally central part of the reference surface 18.

Figure 4:
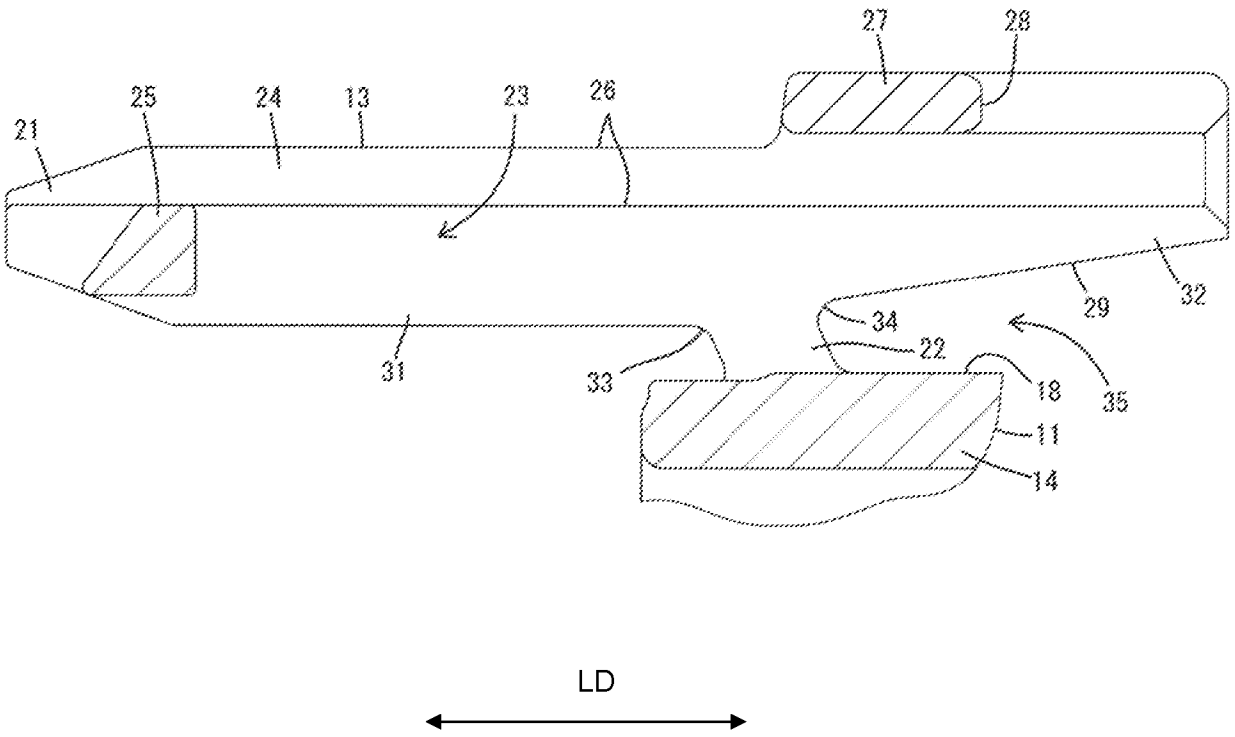
FIG. 4 is a partial enlarged section of FIG. 3.

As shown in FIG. 4, the lock arm 13 extends in the front-rear direction (or longitudinal direction LD) and comprises an arm body 21 (arranged substantially in parallel to the reference surface 18) and legs 22 projecting from the reference surface 18 and/or connected to an intermediate location of the arm body 21 in the front-rear direction LD (specifically, location slightly behind a center of the arm body 21 in the front-rear direction LD). The arm body 21 is inclinable and displaceable in a seesaw manner in the vertical direction with the legs 22 as support. Note that, in the following description, the front-rear direction or longitudinal direction LD is based on a natural state where the arm body 21 is neither inclined nor displaced.

A rearwardly open space 23 is provided in a laterally central part of the lock arm 13 and extends in the front-rear direction LD. As shown in FIGS. 1 and 2, the detector 60 is inserted into the space 23 from behind.

As shown in FIG. 6, two of the legs 22 stand at left and right sides of the space 23. The arm body 21 includes two parallel beams 24 arranged on both left and right sides of the space 23. A lock body 25 extends in the lateral direction and couples front end parts of the respective beams 24. The upper end (standing end) of each leg 22 is coupled to an intermediate location of the corresponding beam 24 in the front-rear direction LD.

The front surface of the lock body 25 is arranged obliquely toward the rear, while the rear surface thereof closes the front end of the space 23 and is arranged substantially vertically and normal to the longitudinal direction LD. The front end of each beam 24 projects farther forward than the lock body 25. The upper surface of each beam 24 is formed as a slide surface 26 arranged substantially horizontally in the front-rear direction LD except at a location corresponding a releasing body 27 to be described later, as shown in FIG. 4. The detector 60 is slidable in the front-rear direction LD along the slide surfaces 26.

The arm body 21 includes the releasing body 27 extending in the lateral direction and coupling the upper surfaces of rear parts of the beams 24 behind and above the space 23. The releasing body 27 is a horizontal rectangular plate with a rearwardly open U-shaped recess 28 in a laterally central part, as shown in FIG. 5. The recess 28 is right above the recess 19.

As shown in FIG. 4, the front area of the arm body 21 is configured as a lock 31 including the lock body 25, and the rear area is configured as a releasing portion 32 including the releasing body 27. The front end of the releasing body 27 is at a position overlapping with each leg 22 in the front-rear direction. The upper surface of the releasing portion 32 (releasing body 27) is slightly higher than the upper surface of the lock 31 and, likewise, the lower surface of the releasing portion 32 (surface facing the reference surface 18, slope 29 to be described later) is higher than the lower surface of the lock 31. Thus, the releasing portion 32 is located above the lock portion 31.

Each leg 22 is inclined forward with respect to the vertical direction from the reference surface 18 toward the arm body 21. A part between the front surface of each leg 22 and the lower surface of each beam 24 on the side of the lock 31 serves as a front coupling 33 in the form of a curved surface, and a part between the rear surface of each leg 22 and the lower surface (slope 29) of each beam 24 on the side of the releasing portion 32 serves as a rear coupling 34 in the form of a curved surface. An angle centered on the front coupling 33 between each leg 22 and each beam 24 on the side of the lock 31 is an obtuse angle, and an angle centered on the rear coupling 34 between each leg 22 and each beam 24 (slope 29) on the side of the releasing portion 32 is an acute angle.

A space enclosed by the rear surfaces of the respective legs 22, the lower surfaces of the respective beams 24 on the side of the releasing portion 32 and the reference surface 18 forms a rearwardly open releasing space 35 for allowing the releasing portion 32 to be displaced down. The lower surface (surface facing the reference surface 18) of each beam 24 on the side of the releasing portion 32 defines the slope 29 inclined straight up from the rear coupling 34 to the rear end of the arm body 21. The releasing space 35 is made larger than normal (mode in which an angle between the rear surface of the leg 22 and the reference surface 18 is a substantially right angle and an angle between the rear surface of the leg 22 and the lower surface of each beam 24 on the side of the releasing portion 32 is a substantially right angle) by each forwardly inclined leg 22 and each slope 29 of the releasing portion 32.

As shown in FIG. 6, a front part of the lock 31 is surrounded by a covering wall 36 of the outer tube 15. The covering wall 36 is U-shaped in a front view, an upper wall 37 covers the lock 31 from above (space opposite to a side facing the reference surface 18) and both left and right side walls 38 are arranged to cover both left and right sides of the lock 31. The upper wall 37 of the covering wall 36 is above the releasing body 27 and includes, as shown in FIG. 5, a substantially U-shaped recessed groove 39 open rearward in a laterally central part. Further, rear parts of both left and right side walls 38 of the covering wall 36 are coupled to the reference surface 18 along the front-rear direction.

The detector 60 is made of synthetic resin and includes a base 61 extending along the lateral direction and a cantilevered resilient locking portion 62 extending forward from the base 61. The detector 60 is inserted into the space 23 from behind and is slidable with respect to the housing body 11 between an initial position IP where the rear end of the base 61 is located behind the rear end of the housing body 11, as shown in FIG. 2, and a detection position DP where the rear end of the base 61 is at substantially the same position in the front-rear direction as the rear end of the housing body 11, as shown in FIG. 1.

The base 61 is fit into the releasing space 35 at the detection position DP and can restrict a downward or inward releasing operation of the releasing body 27. A fitting recess 63 in the form of a slit groove into which the releasing body 27 can fit is open in the front surface of the base 61 and between the base 61 and the resilient locking portion 62. A claw-like partial locking portion 64 projects slightly on a front part of the inner surface of the fitting recess 63.

A claw-like retaining portion 65 projects in a central part of the upper surface of the resilient locking portion 62 in the front-rear direction LD. A locking projection 66 projects down on a front end part of the resilient locking portion 62. The front surface of the locking projection 66 is arranged substantially vertically and the rear surface thereof is arranged obliquely toward the rear.

The connector of this embodiment is structured as described above. Next, functions and effects are described.

During assembly, the detector 60 is inserted into the space 23 of the housing 10 from behind and is left at the initial position IP, as shown in FIG. 2. At the initial position IP, the base 61 is inserted into a rear part of the releasing space 35 and the locking projection 66 of the resilient lock 62 is arranged to contact the rear surface of the lock body 25. Further, an upper part of the base 61 is inserted into the recess 28 of the releasing body 27, the releasing body 27 is inserted into the fitting recess 63 of the base 61, the retaining portion 65 of the resilient lock 62 is arranged to come into contact the front surface of the releasing body 27 and the partial lock 64 is arranged to contact the upper edge of the rear end of the releasing body 27. In this way, the detector 60 is held at the initial position IP with respect to the housing 10 with movements in the front-rear direction LD restricted.

The housing 10 then is connected to the mating housing 90. In the process of connecting the housings 10, 90, the receptacle 92 is fit into the outer tube 15 of the housing body 11 and the mating lock 94 contacts the front surface of the lock body 25 of the lock arm 13. As the connection proceeds, the lock body 25 slides on the mating lock 94, the arm body 21 inclines in a seesaw manner with each leg 22 as a support, the lock 31 is displaced up and the releasing portion 32 is displaced down toward the releasing space 35. At this time, the detector 60 also is inclined and displaced together with the lock arm 13 and the lower end of the base 61 is inserted into the recess 19 of the reference surface 18 to avoid interference of the base 61 and the reference tube 14.

When the housings 10, 90 are connected properly, the arm body 21 resiliently returns to an initial substantially horizontal posture and the rear surface of the lock body 25 is arranged to be locked to the mating lock 94. In this way, the housings 10, 90 are held in the connected state. Note that, when the arm body 21 resiliently returns, the lower surfaces of the respective beams 24 on the side of the lock 31 collide with the upper wall outer surface of the receptacle 92 to generate a locking sound. Thus, by hearing this, it can be audibly detected that the housings 10, 90 have been connected properly.

Further, as the housings 10, 90 are connected properly, the mating locks 94 are inserted into the space 23 to press the locking projection 66, the locking projection 66 is separated from the lock body 25 and the resilient locking portion 62 is deflected and deformed up. Since locking between the partial locking portion 64 and the releasing body 27 easily can be released manually, the detector 60 becomes movable to the detection position DP.

After the housings 10, 90 are connected properly, the detector 60 is pushed forward (toward the detection position DP). The detector 60 can be guided by the slide surfaces 26 and can reach the detection position DP. As shown in FIG. 1, at the detection position DP, the resilient locking portion 62 resiliently returns to the initial substantially horizontal posture and the locking projection 66 is arranged to be lockable to the front surface of the lock body 25. Further, at the detection position DP, the base 61 is inserted substantially over the entire area of the releasing space 35 in the front-rear direction LD, the upper part of the base 61 is fit in the recess 28, the partial lock 64 is arranged to contact the upper edge of the front end of the releasing body 27 and the front surface of the upper end of the base 61 is arranged to contact the back end of the recessed groove 39 in the upper wall 37 of the covering wall 36. In this way, the detector 60 is held at the detection position DP with respect to the housing 10 with movements in the front-rear direction LD restricted.

Note that if the connecting operation is stopped without the housings 10, 90 being properly connected, the mating lock 94 does not reach the position where the mating lock 94 can press the locking projection 66. Thus, the locked state of the locking projection 66 and the lock body 25 is maintained and the detector 60 cannot be moved to the detection position DP. Therefore, it can be detected that the housings 10, 90 have been connected properly if the detector 60 can move to the detection position DP.

The locked state of the locking projection 66 and the lock body 25 can be released by a tool to separate the housings 10, 90 for maintenance or another reason. In that state, the detector 60 is pulled back toward the initial position IP. After the detector 60 returns to the initial position IP, the upper surface of the releasing body 27 is pressed. Thus, the arm body 21 is inclined to lower the releasing portion 32 into the releasing space 35. At this time, since the base 61 is inserted in the rear part of the releasing space 35, an inclination allowing area of the arm 21 in the releasing space 35 is limited.

Each leg 22 is shaped to be inclined forward from the reference surface 18 toward the arm body 21, and the releasing space 35 becomes wider by as much as each leg 22 is inclined forward. Thus, the smoothness of the inclination displacement of the arm body 21 is ensured and good releasing operability can be maintained. Further, a height (vertical dimension) of the housing 10 can be small. Particularly, the covering wall 36 is above the lock 31, which easily leads to a height increase of the housing 10. Thus, a benefit of being able to suppress the height of the housing 10 by inclining each leg 22 forward is large.

In addition, the lower surface of the releasing portion 32 is more distant from the reference surface 18 than the lower surface of the lock 31, and the entire lower surface of the releasing portion 32 serves as the slope 29 inclined in a direction to be separated more from the reference surface 18 from the side of the leg portion 22 toward the rear side. Thus, the releasing space 35 can be ensured to be wider and releasing operability can be improved.

Further, since the rear coupling 34 between the lower surface of the releasing portion 32 and the rear surface of each leg 22 is formed into a curved surface, stress applied to the rear coupling 34 can be dispersed when the releasing portion 32 is pressed so that the lock arm 13 is more durable.

Other embodiments of the invention are briefly described.

The reference surface and the arm body have only to be arranged along the front-rear direction and may partially include an uneven part or a curved surface part.

Although the detector is inserted into the releasing space portion in the case of the above embodiment, a member other than the detecting member such as a wire cover may be inserted into the releasing space portion.

Although the detector is inserted into the releasing space in the case of the above embodiment, a member to be inserted into the releasing space portion may not be substantially present.

The lock body of the lock arm may be in the form of a projection capable of locking the mating lock.

The housing body may be integrated with a part corresponding to the inner housing and may be in the form of a block. Alternatively, in the case of application to a male housing, a housing body may be in the form of a receptacle.

The present teaching is applicable also to non-waterproof type connectors.

REFERENCE SIGNS

10 . . . housing
11 . . . housing body
13 . . . lock arm
18 . . . reference surface
21 . . . arm
22 . . . leg
29 . . . slope
31 . . . lock
32 . . . releasing portion
35 . . . releasing space
36 . . . covering wall
60 . . . detector
90 . . . mating housing
94 . . . mating lock

What is claimed is:

1. A connector, comprising:

a housing body having a front end that is connectable to a mating housing and having a reference surface extending substantially along a longitudinal direction;

an arm body extending substantially along the longitudinal direction; and at least one leg coupling an intermediate location of the arm body in the longitudinal direction and the reference surface, an area on a front side of the intermediate location of the arm body that is coupled to the leg defining a lock and an area on a rear side of the intermediate location of the arm body that is coupled to the leg and substantially opposite to the front side defining a releasing portion; and in a process of connecting the housing body to the mating housing, the area on the first side of the intermediate location of the arm body initially deflects away from the reference surface and then resiliently returns so that the lock locks a mating lock on the mating housing, whereas the releasing portion is displaced toward the reference surface for separating the lock from the mating lock and releasing a locked state with the mating lock when the arm body is inclined with the leg defining a support, and wherein the leg is inclined forward from the reference surface toward the arm body.

2. The connector of claim 1, wherein a surface of the releasing portion adjacent the leg and facing the reference surface is more distant from the reference surface than a surface of the lock substantially facing reference surface.

3. The connector of claim 1, wherein a surface of the releasing portion substantially facing the reference surface is inclined to be more separated from the reference surface at all locations thereon from the leg toward the rear side.

4. The connector of claim 1, further comprising at least one covering wall arranged in a space on a side substantially opposite to a side where the lock substantially faces the reference surface.

5. The connector of claim 1, wherein a part between a surface of the releasing portion facing the reference surface and a rear surface of the leg is formed into a curved surface.

6. The connector of claim 1, wherein a space enclosed by the leg, a portion of the arm body on the side of the releasing portion and the reference surface forms a releasing space for allowing the releasing portion to be displaced.

7. The connector of claim 1, further comprising a detector to be inserted into a space of the housing body and substantially slidable with respect to the housing body between an initial position and a detection position to detect a proper connection of the housing body to the mating housing.

8. A connector assembly comprising the connector of claim 1 and a housing body connectable thereto.

9. The connector of claim 1, wherein a projecting direction of the leg is inclined forward from the reference surface toward the arm body.

10. The connector of claim 1, wherein the leg has front and rear surfaces with concave curves joining the arm body and the reference surface, areas of the front and rear surfaces between the concave curves being inclined forward from the reference surface toward the arm body.

* * * * *